US009140416B2

(12) United States Patent
Bostic

(10) Patent No.: US 9,140,416 B2
(45) Date of Patent: Sep. 22, 2015

(54) TOILET BOLT FINIAL NIGHT LIGHT

(76) Inventor: Krista L. Bostic, Houston, TX (US)

( * ) Notice: Subject to any disclaimer, the term of this patent is extended or adjusted under 35 U.S.C. 154(b) by 287 days.

(21) Appl. No.: 13/552,509

(22) Filed: Jul. 18, 2012

(65) Prior Publication Data

US 2014/0022775 A1 Jan. 23, 2014

(51) Int. Cl.

| | |
|---|---|
| ***F21L 4/00*** | (2006.01) |
| ***F21V 21/00*** | (2006.01) |
| ***F21V 33/00*** | (2006.01) |
| ***F21V 23/04*** | (2006.01) |

(52) U.S. Cl.

CPC . *F21L 4/00* (2013.01); *F21V 21/00* (2013.01); *F21V 23/0464* (2013.01); *F21V 33/004* (2013.01)

(58) Field of Classification Search

CPC ..... F21L 4/00; F21V 21/145; F21V 23/04; F21V 23/0442; F21Y 2101/02; B60Q 1/326; B62J 6/20; A63C 2203/14

USPC ..... 362/191, 500, 802; 4/661

See application file for complete search history.

(56) References Cited

U.S. PATENT DOCUMENTS

| | | | | |
|---|---|---|---|---|
| 1,477,524 | A | 12/1923 | Ruttenberg | |
| 1,994,978 | A | 3/1935 | Brown | |
| 2,008,047 | A | 7/1935 | Stangl | |
| 2,538,483 | A | 1/1951 | Summers | |
| 2,653,835 | A | 9/1953 | Nelson | |
| 2,795,144 | A | 6/1957 | Morse | |
| 3,241,427 | A | 3/1966 | Bosler | |
| 3,601,823 | A | 8/1971 | Isaacs | |
| 3,669,171 | A | 6/1972 | Yavitch | |
| 3,982,288 | A | 9/1976 | Borne | |
| 4,800,469 | A * | 1/1989 | Leon | 362/473 |
| 4,872,095 | A * | 10/1989 | Dubak et al. | 362/100 |
| 4,955,773 | A | 9/1990 | Toth | |
| 5,003,648 | A | 4/1991 | Anderson | |
| 5,163,797 | A | 11/1992 | Patti | |
| 5,262,209 | A * | 11/1993 | Sawyer | 428/28 |
| 5,263,209 | A | 11/1993 | Pattee | |
| 5,276,595 | A | 1/1994 | Patrie | |
| 5,513,397 | A | 5/1996 | Terry | |
| 5,890,794 | A * | 4/1999 | Abtahi et al. | 362/294 |
| D417,491 | S | 12/1999 | Frazer et al. | |
| 6,053,683 | A | 4/2000 | Cabriran | |
| 6,231,203 | B1 | 5/2001 | Olshausen | |
| 6,254,141 | B1 | 7/2001 | Piper | |
| 6,467,939 | B2 * | 10/2002 | Deutsch et al. | 362/500 |

(Continued)

FOREIGN PATENT DOCUMENTS

| | | |
|---|---|---|
| CN | 229512 | 9/1998 |
| WO | WO 2009/105102 | 8/2009 |

*Primary Examiner* — Jong-Suk (James) Lee
*Assistant Examiner* — Mark Tsidulko
(74) *Attorney, Agent, or Firm* — Richard C. Litman

(57) ABSTRACT

The toilet bolt finial night light provides a moisture-proof cover for the anchor bolts of the toilet having a low-power illumination and automatic light sensing switch capability. The toilet bolt finial night light automatically illuminates in a low ambient light environment, and automatically reverts to no illumination when the ambient light of the environment is a bright level. Additionally, the toilet bolt finial night light has a manual ON/OFF switching capability, which overrides the light sensor switch. In addition, the toilet bolt finial night light has translucent and interchangeable tops for providing selecting decorative embellishments. This permits many decorative options. For example, thematic or seasonal ornamentations can be used.

4 Claims, 4 Drawing Sheets

(56) References Cited

U.S. PATENT DOCUMENTS

| | | | | |
|---|---|---|---|---|
| 6,827,539 | B2 | 12/2004 | Somers et al. | |
| D527,810 | S | 9/2006 | Frazer et al. | |
| 7,434,960 | B2 | 10/2008 | Stuhlmacher, II et al. | |
| 7,568,580 | B2 * | 8/2009 | Fenton | 206/390 |
| 7,658,580 | B1 | 2/2010 | Conway et al. | |
| 8,061,872 | B2 * | 11/2011 | Lu et al. | 362/267 |
| 8,210,785 | B1 * | 7/2012 | Gager | 411/429 |
| 8,434,896 | B1 * | 5/2013 | Embry | 362/249.02 |
| 2010/0277952 | A1 * | 11/2010 | Chien | 362/641 |
| 2011/0241555 | A1 | 10/2011 | Lin et al. | |
| 2012/0068613 | A1 * | 3/2012 | Veneto | 315/159 |

* cited by examiner

TOILET BOLT FINIAL NIGHT LIGHT

BACKGROUND OF THE INVENTION

1. Field of the Invention

The present invention relates to toilets, and particularly to a toilet bowl anchor bolt finial night light with low-power illumination and automatic light sensing switch capability.

2. Description of the Related Art

Toilets are usually secured to the floor of a bathroom by threaded studs that extend through the base of the toilet and corresponding nuts threaded over the toilet base. While such fasteners are effective to secure the toilet, the studs are unsightly, and after a number of years, they tend to rust. Plastic caps are available to cover the tops of the studs, but such caps are not very decorative and tend to crack or deteriorate over time. In addition, most people keep their bathroom light turned off at night. When it is necessary to use the bathroom, people tend to grope for the bathroom light in the dark, unless there is a nightlight plugged into a wall outlet. It can be difficult to locate a wall switch in the dark, particularly for children. It would be desirable to provide a decorative cover for toilet bolts, and particularly one that can also provide at least a low level of illumination in the bathroom to aid in locating a wall switch.

Thus, a toilet bolt finial night light solving the aforementioned problems is desired.

SUMMARY OF THE INVENTION

The toilet bolt finial night light provides a decorative cover for a toilet bowl anchor bolt that also provides a low level of illumination, similar to a night light. The toilet bolt finial night light provides a moisture-proof cover for the anchor bolts of the toilet and a low-power illumination and automatic light sensing switch capability. The device automatically illuminates in a low ambient light environment, and automatically reverts to no illumination when the ambient light of the environment is at a bright level. Additionally, the toilet bolt finial night light has a manual ON/OFF switch, which overrides the light sensor switch. In addition, the toilet bolt finial night light has translucent and interchangeable tops for providing selecting decorative embellishments. This permits many decorative options. For example, thematic or seasonal ornamentations can be used. The device has a base that may be left in place on the bolt while changing the translucent cover to suit the decor.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
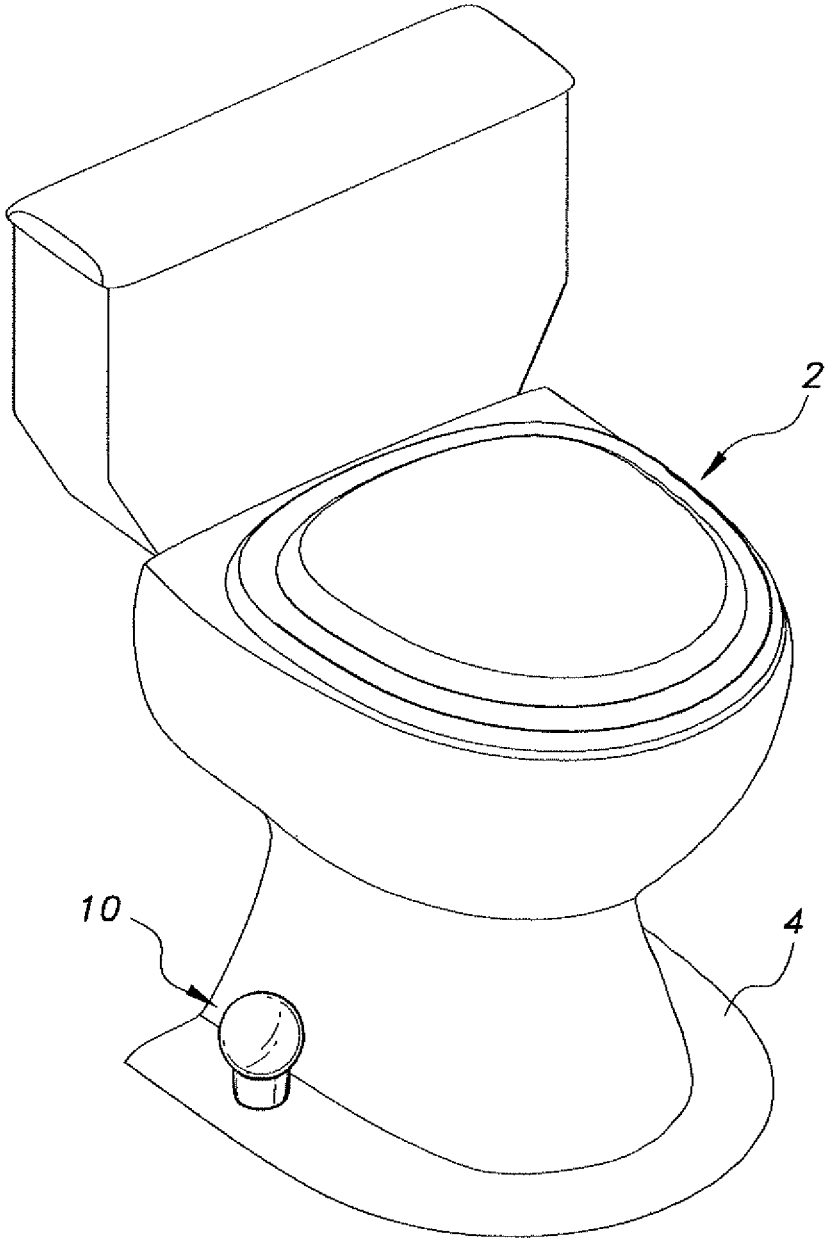
FIG. 1 is an environmental view of a toilet bolt finial night light according to the present invention.

Referring to FIG. 1, a toilet or commode 2 (hereafter referred as toilet 2) has a base flange 4 through which a pair of anchor bolts (not shown) or studs protrude. A pair of nuts engage the bolts to secure the toilet 2 to the floor or supporting structure. As shown in FIG. 1, the toilet bolt finial night light 10 is adapted for mounting atop the anchor bolts and nuts that secure the base flange 4 of the toilet 2. Optionally, the finial night light 10 may be used in lieu of the nut to secure the toiled base to the anchor bolt. It is understood that although only one side of the toilet 2 is shown, the toilet bolt finial night light 10 is usually attached to both sides of the toilet 2.

Figure 2:
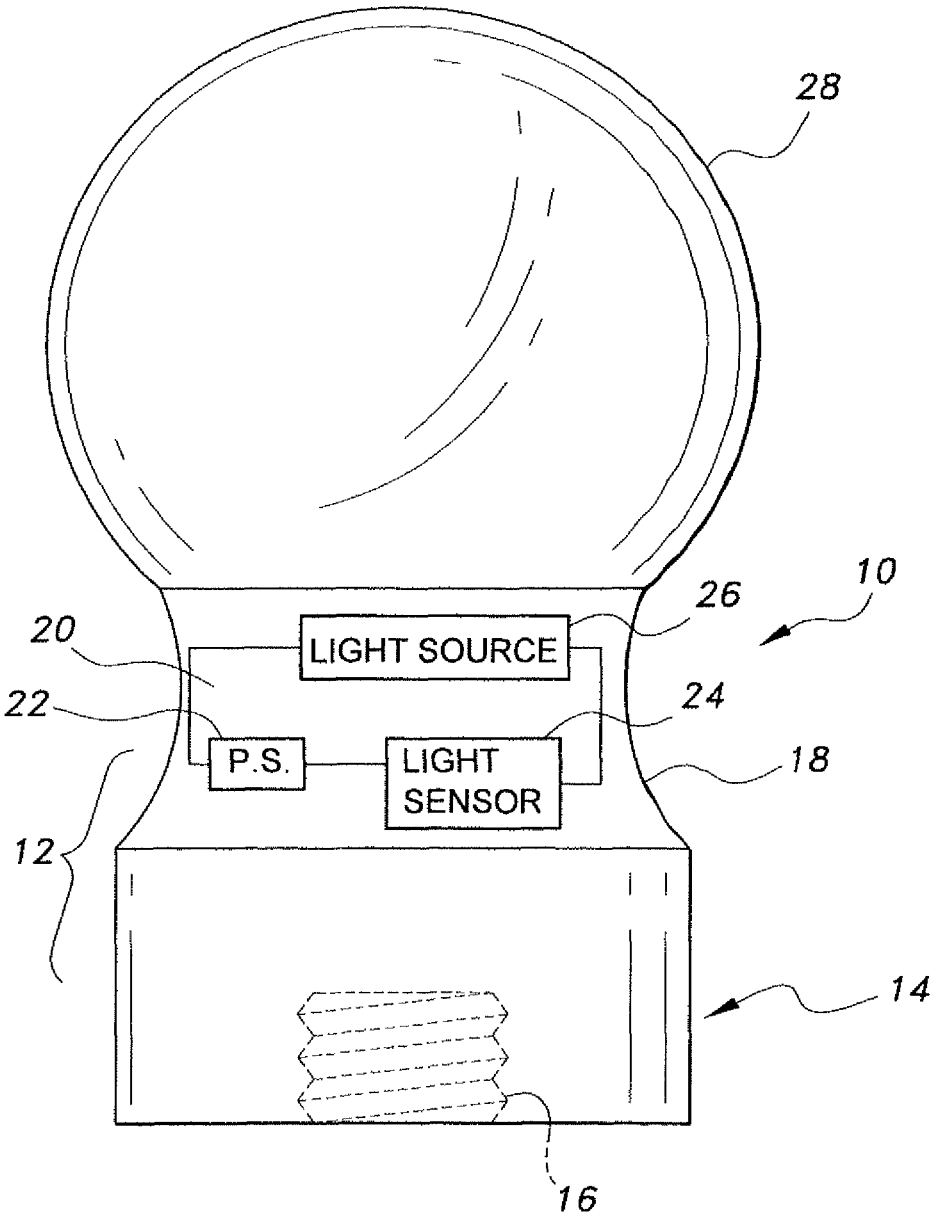
FIG. 2 is a diagrammatic side view of a toilet bolt finial night light according to the present invention.

Referring to FIG. 2, the toilet bolt finial night light 10 includes a base 12, an electrical circuit 20, and an ornamental top or cover 28. The base 12 has a lower section 14 and an upper section 18. The lower section 14 has a centrally defined socket or internally threaded bore 16 for engaging the toilet anchor bolt. The socket 16 is dimensioned and configured to engage the anchor bolt in such a fashion that it securely affixes the toilet bolt finial night light 10 to the anchor bolt. The socket 16 has helical threads for engaging the anchor bolt, securing the toilet bolt finial night light 10 atop the bolt. Alternatively, the socket 16 may be form a pressure fit or friction fit with the toilet anchor bolt. As a further alternative, an additional washer may be provided between the anchor nut and the base flange 4, and the toilet bolt finial night light 10 may snap fit onto the washer. In any arrangement, the socket 16 provides an enclosed and dry environment, generally maintaining a watertight seal about the anchor bolt (and nut) to prevent corrosion of the bolt. In addition, a washer, such as a rubber or silicone washer, may be provided to insure that there is a watertight seal about the toilet anchor bolt, and to prevent any marring or scratching of the finishes of the toilet 2 and finial 10. The toilet bolt finial night light 10 ensures the maintenance of the toilet anchor bolt and nut by preventing deterioration or rusting thereof. In addition, the toilet bolt finial night light 10 contributes to the aesthetic quality of the toilet 2.

The upper section 18 of the base 12 provides an enclosure for the circuit 20, and a releasable attachment for the ornamental top or cover 28. The base 12 is formed of a generally solid material, with the socket 16 formed in the lower section 14. Likewise, a portion of the upper section 18 includes a well or depression for containing the circuit 20. In addition, the upper section 18 also has a coupling for attaching the ornamental top or cover 28 to the upper section of the base 12 of the toilet bolt finial night light 10.

The light circuit 20 is configured for producing light when ambient lighting conditions surrounding the toilet bolt finial night light 10 are at a predetermined low level or relatively dark. The circuit 20 generally includes a power source 22, a light sensor 24, and a light source 26. These components are operatively and electrically connected so that when a predetermined low ambient light condition occurs, the light source 26 will be energized via the power source 22. The power source 22 also provides electrical power at the light sensor 24 so that the when the light sensor 24 detects a low ambient light condition, the light sensor 24 actuates a switching mechanism, thus igniting the light source 26. The light sensor 24 may be a photocell or phototransistor.

Figure 3:
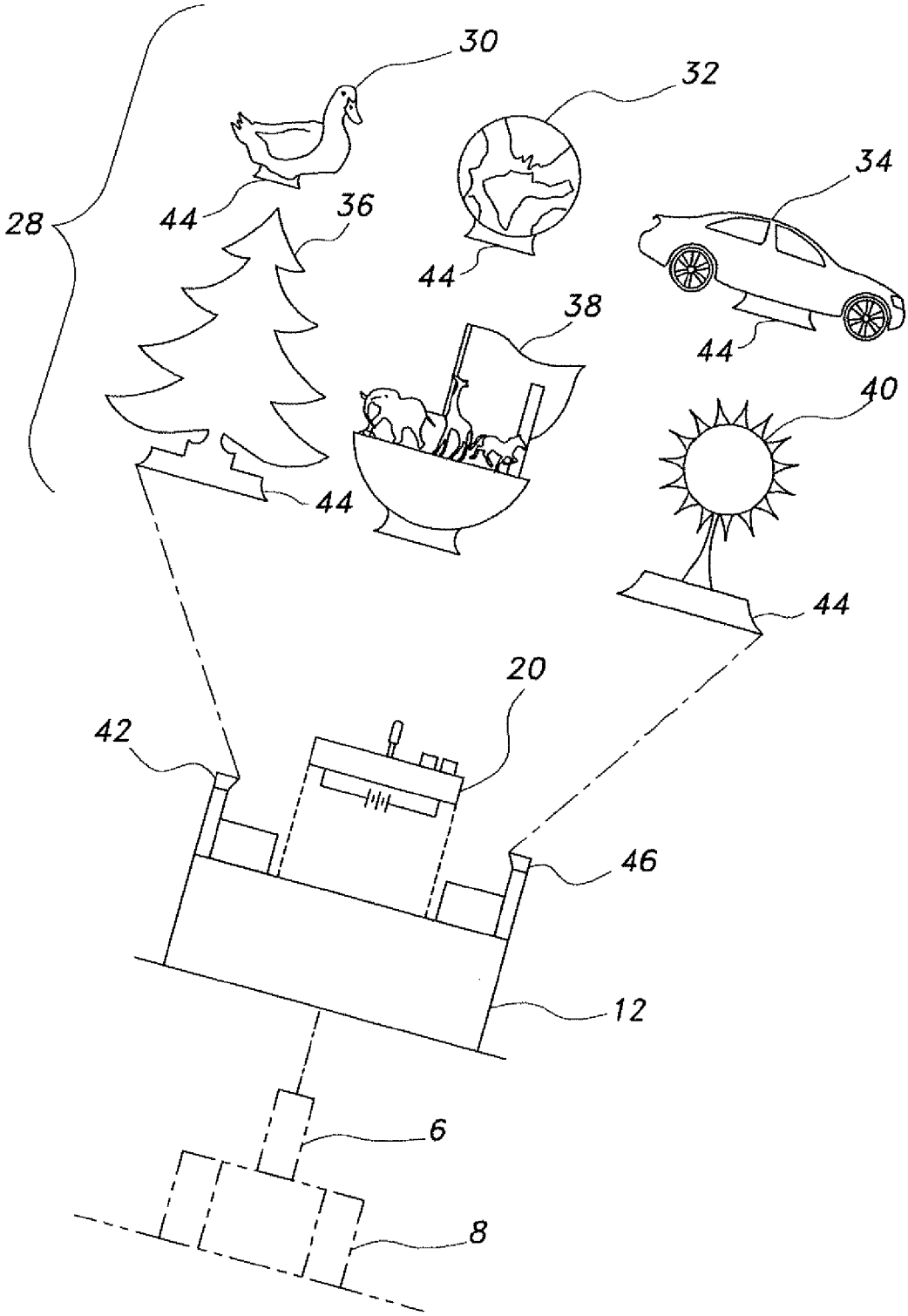
FIG. 3 is an exploded perspective view of a toilet bolt finial night light according to the present invention, including an exemplary kit of interchangeable decorative translucent covers.

Referring to FIG. 3, the structural relationship of the toilet bolt finial night light 10 is shown. As seen in phantom, a toilet anchor bolt 6 and an associated anchor nut 4 secures the base flange 4 of the toilet 2 to a supporting structure. The toilet bolt finial night light 10 is mounted atop the toilet anchor bolt 6 and nut 4, as discussed above, in order to prevent moisture from accumulating, consequently preventing the deterioration or rusting thereof. The exploded view shows an exemplary kit of options or choices for the ornamental top or cover 28. The covers 28 shown in the drawing are exemplary, and merely a sampling of the vast array of designs usable with the night light 10. As seen in FIG. 3, the upper portion 18 of base 12 has a depression for receiving the circuit 20 therein. Surrounding the circuit 20 in the depression is an outer wall and an attachment coupling 42. Illustrated herein, the wall and attachment coupling 42 include a flange 46, which may be an annular flange, protruding inwardly of the depression about the circuit 20. The flange 46 is dimensioned and configured to readily accept and matingly engage a corresponding finial attachment 44 at the bottom of the ornamental top or cover 28. Upon engagement of the flange 46 and the finial attachment 44, the circuit 20 is enclosed in a virtually hermetically sealed environment. Thereby, the operation of the circuit 20 is functionally stable against environmental factors, such as water, cleaning solutions, humidity, and so on. Although the flange 46 and the finial attachment 44 are shown as a type of snap-fit engagement, the base 12 and the cover 28 may have mating threads or any other form of coupling, so long as the interior of the ornamental top or cover 28 and the depression containing circuit 20 remain virtually hermetically sealed.

Also seen in FIG. 3 is a sampling of the variety of choices for the ornamental top or cover 28. Each cover in the kit has the finial attachment bottom 44 for attachment to the upper portion 18 of the base 12. The kit of ornamental tops or covers may include animal varieties, illustrated by a duck 30. In addition, orbs 32 (such globes, balls, etc.), vehicles 34 (such as cars, trucks, boats, etc.), holiday themes (such as Christmas trees 36 and religious themes 38), and toys and novelties (such as a magic wand 40) are further examples of the multitude of decorative designs for the ornamental top or cover 28.

Still referring to FIGS. 1-3, the composition of the ornamental top or cover 28 is highly translucent. That is, the material or materials used to form the ornamental top or cover 28 ranges from transparent to nearly opaque. This broadly encompasses a vast array of materials and colorations to make the ornamental top or cover 28. In this manner, the light source 26, upon activation, will illuminate from within the ornamental top or cover 28, and the illumination is readily visible external to the ornamental top or cover 28. The light source 26 preferably has low intensity, although highly visible. When illuminating from the interior of ornamental top or cover 28, the decorative and ornament design will provide an aesthetically appealing feature to the toilet 2. The choice of ornamental top or cover 28 may be selectively chosen from seasonal or holiday, child, sports, educational, novelty or hobby themes. The toilet bolt finial night light 10 would be generally provided in pairs because standard toilets 2, particularly in the home, have a pair of anchor bolts and nuts.

Figure 4:
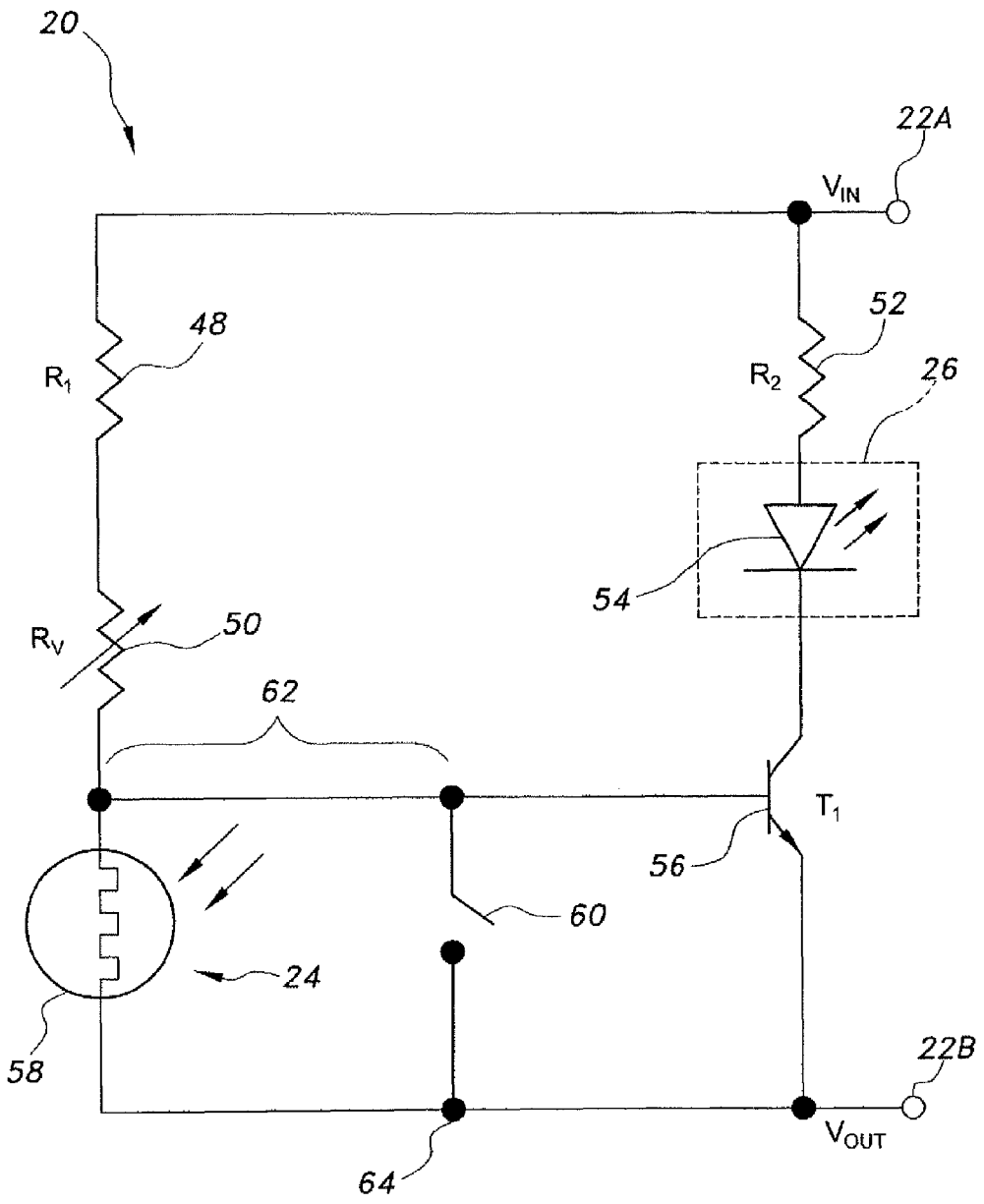
FIG. 4 is a schematic diagram of an exemplary light circuit used in a toilet bolt finial night light according to the present invention.

Referring to FIG. 4, the circuit 20 provides a control operation of a light source 26. The circuit has a power supply 22, which is indicated as providing $V_{in}$ 22A and $V_{out}$ 22B. The power supply 22 may be batteries, typically of the dry cell type; including any long life or rechargeable cells, button- or watch-type, lithium, or the like. Additionally, household AC is an option, using a standard AC/DC transformer or converter. Likewise, other sources for providing power, such as solar cell, photovoltaic cell, or photoelectric cell would be useable for providing power. Between the $V_{in}$ 22A and $V_{out}$ 22B from the power supply 22 are the circuit components for producing the operative functions of the circuit 20. The circuit 20 includes the light source 26, the light sensor 24, and switching mechanisms.

The light source 26 may be a standard light emitting diode (LED) 54. Typically, the LED 54 is a low power-consuming, low heat-generating, high light-producing element. As such, it is the optimum choice for the light source 26. Alternatively, other types of light sources may be substituted, and the light source 26 may be chosen from compact fluorescent lights (CFLs), incandescent bulbs, as well as any of the myriad of light-producing elements available in the market. The light source 26 may be a single LED 54 or a plurality of LEDs.

The light sensor 24 of the present embodiment is a photoconductive light sensor. A photoconductive light sensor does not produce electricity, but simply changes its physical properties when subjected to light energy. The most common type of photoconductive device is the photoresistor which changes its electrical resistance in response to changes in the light intensity. Photoresistors are semiconductor devices that use light energy to control the flow of electrons, and hence the current flowing through them. The photoconductive cell may be a Light Dependent Resistor (LDR) 58. The LDR 58 is provided between nodes 62 and 64.

As its name implies, the LDR 58 is made from a piece of exposed semiconductor material, such as cadmium sulfide, that changes its electrical resistance from several thousand ohms in the dark to only a few hundred ohms when light falls upon it by creating hole-electron pairs in the material. The net effect is an improvement in its conductivity with a decrease in resistance for an increase in illumination. Materials used as the semiconductor substrate include lead sulfide (PbS), lead selenide (PbSe), and indium antimonide (InSb), which detect light in the infra-red range, with the most commonly used of all photoresistive light sensors being cadmium sulfide (CdS). Cadmium sulfide is used in the manufacture of photoconductive cells because its spectral response curve closely matches that of the human eye, and can even be controlled using a simple torch as a light source. Typically then, it has a peak sensitivity wavelength ($\lambda p$) of about 560 nm to 600 nm in the visible spectral range. Thus, the LDR 58 effectively responds to changing ambient conditions in the toilet 2 environment as would a human user, providing light response when needed.

Other types of light sensors 24 suitable for the described embodiment are photojunction devices, such as photodiodes, phototransistors, photodarlingtons, photo-thyristors, and silicon controlled rectifiers (SCR). It should be noted that the use of photovoltaic cells as both light sensor 24 and power supply 22 are also contemplated in the present circuit 20.

The illumination of the LED 54 is accomplished when a transistor device ($T_1$) 56 is conducting, i.e., when the base is provided with a voltage via node 62. The presence of a voltage causes the transistor 56 to conduct current through the collector and emitter, thereby allowing electrical energy from $V_{in}$ 22A to flow through LED 54 to $V_{out}$ 22B, causing LED 54 to illuminate. When LDR 58 is in a high ambient light environment, it is more conductive, thereby allowing current to flow through it, causing a voltage to not be present at the base of transistor 56. When the LDR 24 is in a low ambient light or a dark condition, it becomes highly resistive, thereby forcing a voltage to be present at the base of transistor 56, allowing current flow through the transistor 54. Consequently, the LED 54 turns on when LDR 58 detects a low ambient light environment.

The resistors 48 and 52 serve as ballast loads or bias resistors to keep currents and voltages in the circuit in an operational range. Variable resistor 50 provides an adjustment to preselect the level of ambient light within which the light source 26 is illuminated. Variable resistor 50 is either preset for optimal performance, or may be a user-defined adjustment for causing illumination at a predetermined level. In addition, a manual switch 60 is provided to turn the toilet bolt finial night light 10 ON or OFF. The manual switch 60 overrides the light sensor 24, thereby disabling the effect of the light sensor 24 on the function of the circuit 20. In addition to ON and OFF positions, the manual switch 60 may have an AUTO position, in which the ambient light sensor 24 switches the light source 26 on and off.

It is to be understood that the present invention is not limited to the embodiments described above, but encompasses any and all embodiments within the scope of the following claims.

I claim:

1. In combination, a toilet, a toilet bolt and a toilet bolt finial night light, comprising:

a toilet;

a toilet bolt for anchoring the toilet;

a toilet bolt finial night light including a base having a lower portion and an upper portion, the lower portion having a socket adapted for attachment to the toilet bolt, the upper portion having an attachment coupling, wherein the socket comprises an internal bore dimensioned and configured to engage the toilet bolt, the socket covering the bolt to provide a moisture-proof cover for the bolt to prevent corrosion;

a light circuit for providing illumination, the light circuit being disposed in the upper portion of the base, wherein the light circuit comprises:

a source of electrical power;

a light source connected to the power source;

an ambient light sensor connected to the light source and the power source; and a switching circuit connected between the light sensor and the light source, the switching circuit being configured to switch the light source on when the ambient light sensor detects that ambient light is below a predetermined level, wherein the switching circuit further comprises:

a manual switch configured to connect and disconnect power from said power source to the light source to turn said light source on and off, wherein the manual switch is configured to switch power to the tight source on and off regardless of ambient light levels sensed by the ambient light sensor; and at least one decorative translucent cover secured to the upper portion of the base by the attachment coupling, the at least one decorative cover being disposed over the light circuit.

2. The combination according to claim 1, wherein said cover has an attachment coupling releasably engaging the attachment coupling of the upper portion of said base, whereby said cover is replaceable to achieve different decorative effects.

3. The combination according to claim 1, wherein said at least one decorative translucent cover comprises a kit having a plurality of decorative translucent covers, each of the covers having a different decorative design, the covers being releasably and interchangeably attachable to said base in order to change the decorative appearance of the toilet bolt finial night light.

4. The combination according to claim 1, wherein said socket comprises an internally threaded bore dimensioned and configured to thread onto the toilet bolt, the socket covering the bolt to provide a moisture-proof cover for the bolt to prevent corrosion.

* * * * *